US005754051A

United States Patent [19]

Miyata et al.

[11] Patent Number: 5,754,051

[45] Date of Patent: May 19, 1998

[54] MISFIRE DETECTING DEVICE

[75] Inventors: Shigeru Miyata; Noriaki Kondo, both of Nagoya, Japan

[73] Assignee: NGK Spark Plug Co., Ltd., Nagoya, Japan

[21] Appl. No.: 755,259

[22] Filed: Nov. 22, 1996

Related U.S. Application Data

[62] Division of Ser. No. 378,262, Jan. 26, 1995, Pat. No. 5,581,188.

[30] Foreign Application Priority Data

Jan. 28, 1994 [JP] Japan ..... 6-8036

[51] Int. Cl.[6] ..... F02P 17/00

[52] U.S. Cl. ..... 324/393; 324/399; 324/388

[58] Field of Search ..... 324/393, 399, 324/388, 402, 392; 123/630, 627; 73/116, 117.3

[56] References Cited

U.S. PATENT DOCUMENTS

| | | | |
|---|---|---|---|
| 4,918,359 | 4/1990 | Schleupen et al. . | |
| 5,027,073 | 6/1991 | Kaller et al. | 324/399 |
| 5,046,470 | 9/1991 | Entenmann et al. | 324/399 |
| 5,269,282 | 12/1993 | Miyata et al. | 324/329 |
| 5,293,129 | 3/1994 | Ikeuchi et al. | 324/399 |
| 5,294,888 | 3/1994 | Miyata et al. | 324/393 |
| 5,418,461 | 5/1995 | Maeda et al. | 324/393 |
| 5,592,926 | 1/1997 | Miyata et al. | 324/388 |
| 5,617,032 | 4/1997 | Inagaki et al. | 324/399 |

FOREIGN PATENT DOCUMENTS

| | | |
|---|---|---|
| 0 513 995 | 11/1992 | European Pat. Off. . |
| 4-134181 | 5/1992 | Japan . |
| WO 92/20912 | 11/1992 | WIPO . |

OTHER PUBLICATIONS

Patent Abstracts of Japan, vol. 017, No. 447, 17 Aug. 1993.
Patent Abstracts of Japan, vol. 018, No. 123, 28 Feb. 1994.

*Primary Examiner*—Maura K. Regan
*Attorney, Agent, or Firm*—Foley & Lardner

[57] ABSTRACT

A misfire detecting device for an ignition system, comprises high voltage applying means for applying a pulsed high voltage to each spark plug of an engine after completion of firing of the spark plug, voltage restricting means for restricting a peak of the pulsed high voltage to a highest possible value that does not cause firing of the spark plug, voltage detecting means for detecting a plug voltage across a center electrode-to-outer electrode of the spark plug after reducing the same, and misfire detecting means for detecting a misfire at each cylinder on the basis of a decay characteristic of a detection voltage which is caused by application of the pulsed high voltage. In another embodiment, the misfire detecting device comprises high voltage applying means which monitors a detection voltage which is caused by application of the pulsed high voltage to each spark plug and controls the pulsed high voltage so that the detection voltage is maintained at a highest possible value that does not cause firing of the spark plug due to application of the pulsed high voltage to the spark plug.

3 Claims, 4 Drawing Sheets

MISFIRE DETECTING DEVICE

This application is a divisional of application Ser. No. 08/378,262, filed Jan. 26, 1995, now U.S. Pat. No. 5,581,188.

BACKGROUND OF THE INVENTION

1. Field of the Invention

The present invention relates to a device for detecting a combustion condition within each cylinder of an engine, i.e., a misfire detecting device for an ignition system of an internal combustion engine.

2. Description of the Prior Art

A prior art distributor type ignition system incorporating a misfire detecting device, is shown in FIG. 4. The ignition system is generally indicated by "D" and includes an ignition coil 921, a battery 923 connected to a primary winding 922 of the ignition coil 921, a power transistor 924, an ECU (engine control unit) 927 for supplying an ignition signal 925 and a control signal 926 in the form of a rectangular pulse, a distributor 928, a reverse current preventing diode "d", spark plugs 930 each connected at a center electrode side to a side electrode 929 and at an outer electrode to a cylinder side so as to be grounded thereat, a voltage dividing circuit 931, and a combustion condition or misfire detecting circuit 932 for detecting a combustion condition or misfire on the basis of the decay characteristic of a divided voltage.

In the ignition system "D", the pulsed high voltage is set or controlled through control of the time of energisation of the primary winding 922.

However, variations or fluctuations of the voltage of the pulsed high voltage are caused due to variations of the specification of the ignition coil 921, variations of the battery voltage, or variations of the performance characteristics of the ignition coil resulting from variations of the temperature.

For this reason, the pulsed high voltage is set low (by setting the time of energisation to be shorter) so that the spark plug is not caused to fire or discharge by the application of the pulsed high voltage. However, this causes a problem in that the pulsed high voltage cannot go over the gap of the distributor or the accuracy of determination of a misfire based on the voltage waveform of a divided voltage 933 is lowered due to an excessively low detection voltage.

Further, in some kind of ignition system or in some kind of engine it is necessary to make earlier the timing for application of the pulsed high voltage in order to improve the accuracy of detection of a misfire. For example, in the distributor type ignition system "D", energisation of the primary winding 922 needs to be started before completion of firing or spark discharge since the time of application of the pulsed high voltage is limited in relation to the width of the distributor rotor at engine high speed. If energisation of the primary winding 922 is started before completion of firing, the build-up speed of the current becomes faster (as compared with the case the energisation is started after completion of firing). Thus, even if the time of energisation of the primary winding 922 is the same, the pulsed high voltage becomes higher, so that application of the pulsed high voltage for detection of a misfire can easily cause the spark plug to fire.

SUMMARY OF THE INVENTION

According to an aspect of the present invention, there is provided a novel and improved misfire detecting device incorporated in an ignition system for intermittently supplying a primary current to a primary winding of an ignition coil for thereby developing an ignition high voltage at a secondary winding of the ignition coil, and applying the ignition high voltage to a plurality of spark plugs provided to respective cylinders of an internal combustion engine. The misfire detecting device comprises high voltage applying means for applying a pulsed high voltage to each spark plug after completion of spark discharge of each spark plug, voltage restricting means for restricting a peak of the pulsed high voltage to a predetrmined value which is set so as not cause spark discharge of each spark plug, voltage detecting means for detecting a plug voltage across a center electrode-to-outer electrode of each spark plug after reducing the same, and misfire detecting means for detecting a misfire at each cylinder on the basis of a decay characteristic of a detection voltage which is caused by application of the pulsed high voltage. With this misfire detecting means, a pulsed high voltage is applied to each spark plug by the high voltage applying means after completion of spark discharge of each spark plug, whilst at the same time the peak of the pulsed high voltage is restricted to a predetermined value which is set at a highest possible value that does not cause firing or discharge of each spark plug. The voltage detecting means detects the plug voltage across the center electrode-to-outer electrode of each spark plug after reducing the same. The misfire detecting means detects a misfire at each cylinder on the basis of a decay characteristic of a detection voltage which is caused by the application of the pulsed high voltage. In case a normal combustion or firing occurs within each cylinder, the electric resistance at the center electrode-to-outer electrode portion is lowered, so the plug voltage attenuates rapidly or in an early time and therefore the detection voltage attenuates in an early time. In case a misfire occurs, the electrical resistance is not lowered, so the speed of decay of the plug voltage is low and therefore the speed of decay of the detection voltage is low.

According to a further aspect of the present invention, there is provided a novel and improved misfire detecting device incorporated in an ignition system for supplying a primary current intermittently to a primary winding of an ignition coil for thereby developing an ignition high voltage at a secondary winding of the ignition coil, and applying the ignition high voltage to a plurality of spark plugs provided to respective cylinders of an internal combustion engine. The misfire detecting device comprises high voltage applying means for applying a pulsed high voltage to each spark plug after completion of spark discharge of each spark plug, and voltage detecting means for detecting a plug voltage across a center electrode-to-outer electrode of each spark plug after reducing the same, in which the high voltage applying means monitors a detection voltage which is caused by application of the pulsed high voltage and controls the pulsed high voltage so that the detection voltage is maintained at a limit value or less that is set so as not to cause spark discharge of each spark plug due to application of the pulsed high voltage to each spark plug. With this misfire detecting device, the high voltage applying means applies a pulsed high voltage to each spark plug after completion of spark discharge of each spark plug, and the voltage detecting means monitors the detection voltage and controls the pulsed high voltage so that the detection voltage is equal to or lower than a limit value. In the meantime, the limit value is set at a highest possible value that does not cause spark discharge of each spark plug due to application of the pulsed high voltage. Further, in case the detection voltage has reached a limit value prior to application of the pulsed high voltage due to a misfire at each cylinder, etc., application of the pulsed high voltage is not performed since there is a possibility that firing or spark discharge of the spark plug is caused by the application of the pulsed high voltage. In case a normal combustion or firing occurs within each cylinder, the electrical resistance across the center electrode-to-outer electrode is lowered, so the plug voltage is lowered in an early time and therefore the detection voltage is lowered in an early time. In case a misfire occurs, the electrical resistance is not lowered, so the speed of decay of the plug voltage is low and therefore the speed of decay of the detection voltage is low.

The above structure is effective for solving the above noted problems inherent in the prior art devices.

It is accordingly an object of the present invention to provide a novel and improved misfire detecting device for an ignition system of an internal combustion engine which makes it possible to set a pulsed high voltage to be applied to each spark plug, i.e., a detection voltage to be detected for determination of a misfire, at a highest possible value that does not cause spark discharge or firing of the spark plug.

It is a further object of the present invention to provide a novel and improved misfire detecting device of the above described character which is highly accurate in detection of a misfire and therefore highly reliable in operation.

DETAILED DESCRIPTION OF THE PREFERRED EMBODIMENTS

Figure 1:
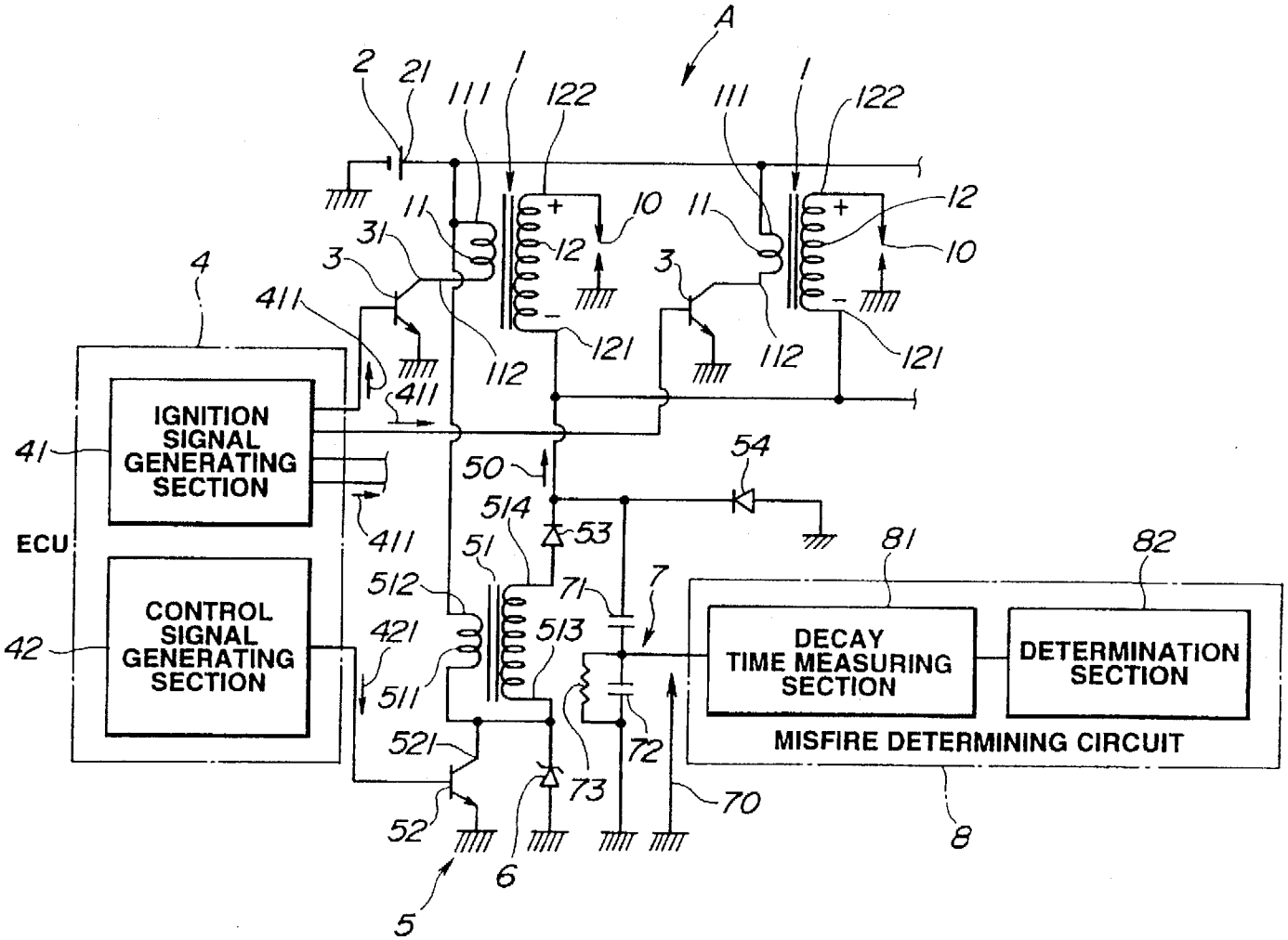
FIG. 1 is a circuit diagram of a single-ended distributorless ignition system having incorporated therein a combustion condition or misfire detecting device according to an embodiment of the present invention.

Referring to FIG. 1, a single-ended distributorless ignition system having incorporated therein a misfire detecting device according to an embodiment of the present invention is generally indicated by "A" and is shown by way of example as being of the type for use in a four-cylinder gasoline engine. The ignition system "A" includes ignition coils 1, a battery 2 and power transistors 3 connected to respective primary windings 11 of the ignition coils 1, an ECU (engine control unit) 4 for producing and supplying an ignition signal 411 to the power transistors 3, spark plugs 10 connected to respective secondary windings 12 of the ignition coils 1, a high voltage generating circuit 5 for generating a high tension pulse or pulsed high voltage 50, a Zener diode 6 serving as a voltage restricting means, a voltage detecting circuit 7 for detecting the potential at a secondary high tension negative terminal 121 after dividing the same, and a combustion condition or misfire determining circuit 8 for receiving a detection voltage 70.

In this embodiment, each ignition coil 1 is of the type for use in a single-ended DLI (distributorless ignition system) and composed of hundreds of turns of the primary winding 11 and tens of thousands of turns of the secondary winding 12 which are wound on an iron core. The iron core is formed from a plurality of thin silicon steel plates which are stacked one upon another. The windings are placed in a casing filled with resin such as epoxy or the like. Each ignition coil 1 has, on the top face of the casing, primary terminals 111 and 112, a secondary high tension negative terminal 121, and a secondary high tension positive terminal 122 which are independent from each other.

The primary terminals 111 of the ignition coils 1 are connected to a positive terminal 21 of the battery 2, whilst the primary terminals 112 are connected to respective collectors 31 of the power transistors 3.

The secondary high tension positive terminals 122 of the ignition coils 1 are connected to respective center electrode sides of the spark plugs 10 by using high tension codes.

The power transistors 3 for allowing battery current to flow intermittently and in turn through the primary windings 11 of each ignition coils 1 are put into an ON/OFF state on the basis of an ignition signal delivered from the engine control unit 4 and make the secondary windings 12 develop a high voltage of several tens of kilovolts when operated to change from the ON state to the OFF state. In the meantime, indicated by 54 is a diode for lowering the ground impedance of the secondary high tension negative terminals 121.

An ignition signal generating section 41 of the ECU 4 determines an optimum ignition timing on the basis of various signals delivered from sensors for detecting engine speed, coolant temperature, cam position, etc. and delivers an ignition signal 411 to the power transistors 3 so that firing or discharge of each spark plug 10 is obtained at the optimum timing.

Further, a control signal generating section 42 of the ECU 4 determines, on the basis of the determined optimum timing, a timing for delivering the high tension pulse or pulsed high voltage 50 and delivers a control signal 421 to the high voltage generating circuit 5.

The spark plugs 10 are installed on the respective engine cylinders one by one and adapted to fire or perform spark discharge when a positive high voltage is applied to the center electrodes during a compression stroke.

The high voltage generating circuit 5 includes, in this embodiment, a coil 51 connected at a primary contact 512 of a primary winding 511 to the positive terminal 21 of the battery 2, a power transistor 52 connected at a collector 521 to an internal connecting terminal 513, and a diode 53 connected at an anode to a secondary terminal 514 and at a cathode to the secondary high tension negative terminal 121.

The coil 51 is, in this embodiment, of the turn ratio of 1:100.

The power transistor 52 is put into an ON/OFF state on the basis of the control signal 421 and allows a high voltage to be developed at the secondary terminal 514 when it is changed from an ON state to an OFF state.

The diode 53 is a reverse current preventing, high withstand voltage diode for applying a high voltage developed at the secondary terminal 514 to the secondary high tension negative terminal 121 as a positive polarity high tension pulse 50 whilst preventing a high voltage to be applied to the secondary high tension negative terminal 121 from being applied reversely to the high voltage generating circuit 5.

The Zener diode 6 placed between the internal connecting terminal 513 and ground (between the collector 521 and the emitter of the power transistor 52) is, in this embodiment, of the kind of the Zener voltage of 20 volts and restricts the voltage applied to the power transistor 52 to about 20 volts.

In this embodiment, by setting the turn ratio of the coil 51 at 1:100 and using the Zener diode 6 of the Zener voltage of 20 volts, it is intended to restrict the peak voltage of the high tension pulse 50 to 2 kilovolts (predetermined value).

The voltage detecting circuit 7 is composed of a condenser 71 of a small capacity connected at an end to the cathode side of the diode 53, a condenser 72 of a relatively large capacity connected at an end to the other end of the condenser 71 and grounded at the other end, and a resister 73 connected in parallel to the condenser 72.

A high voltage is divided according to the capacity ratio of the condensers 71 and 72, and the detection voltage 70 is input to the misfire detecting circuit 8.

A decay time measuring section 81 of the misfire determining circuit 8 measures the decay time of each detection voltage 70 which is developed each time of application of the high tension pulse 50. A determination section 82 determines a misfire at each cylinder on the basis of how the detection voltage 70 attenuates or decays.

In the meantime, when a normal combustion occurs within the cylinder, i.e., normal firing of the spark plug occurs, the plug voltage across the center electrode-to-outer electrode attenuates rapidly or in an early time, so the detection voltage 70 attenuates in an early time. Further, when a misfire occurs, the electric resistance of the center electrode-to-outer electrode portion is maintained high, so that the plug voltage attenuates gradually and therefore the detection voltage 70 attenuates gradually.

Then, the advantage of the above described embodiment will be described.

(a) By setting the turn ratio of the coil 51 at 1:100 and using the Zener diode 6 of the Zener voltage of 20 V, the peak voltage of the high tension pulse 50 is restricted to a highest possible value (2 kV) that does not cause firing or discharge of the spark plugs 10.

Due to this, the spark plugs 10 are not caused to fire or discharge by the application of the high tension pulse 50. Further, it becomes possible to apply a highest possible voltage that does not cause spark discharge to the spark plugs 10, and therefore the resulting judgment of the combustion condition or misfire is highly accurate.

Another embodiment of the present invention will be described with reference to FIGS. 2 and 3.

Figure 2:
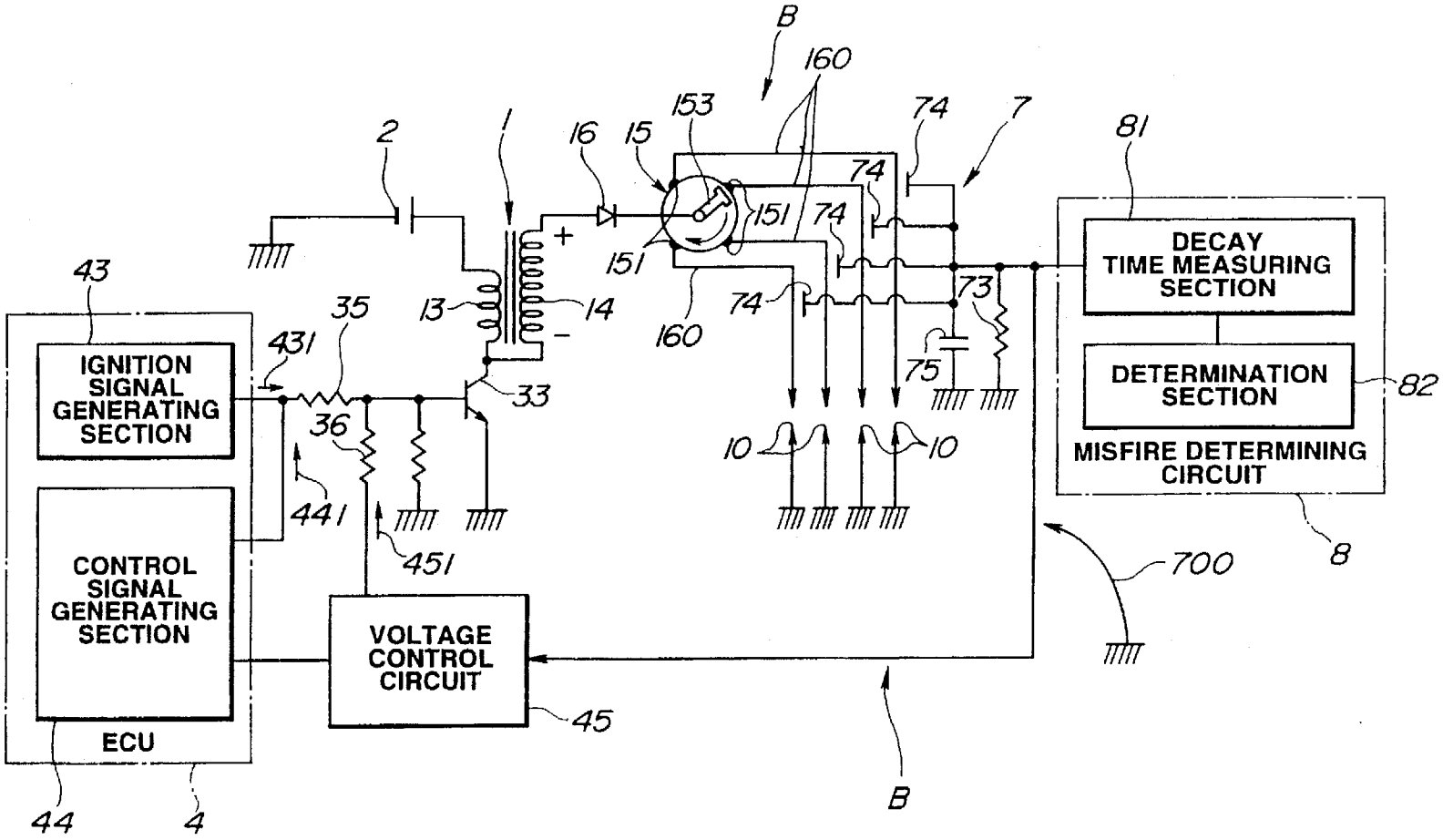
FIG. 2 is a circuit diagram of a distributor type ignition system having incorporated therein a combustion condition or misfire detecting device according to another embodiment of the present invention.

As shown in FIG. 2, a distributor type ignition system "B" having incorporated therein a combustion condition or misfire detecting device of this embodiment is of the type for use in a four-cylinder gasoline engine and includes an ignition coil 1, a battery 2 connected to a primary winding 13 of the ignition coil 1, a power transistor 33, an ECU (engine control unit) 4 for delivering an ignition signal 431 and a control signal 441, a distributor 15, spark plugs 10 connected to a side electrode 151 side of the distributor 15, a voltage detecting circuit 7 for dividing a plug voltage to 1/500, and a misfire determining circuit 8.

The high voltage developed at the ignition coil 1 is transmitted by way of a reverse current preventing diode 16 to the center electrode 152, then applied through the center contact piece to the rotor 153, and distributed to the spark plugs 10 by way of the side electrodes 51 and the high tension codes 160.

The ignition signal generating section 43 of the ECU 4 determines an optimum firing timing on the basis of various signals delivered from sensors for detecting engine speed, coolant temperature, cam position, etc. and delivers an ignition signal 431. The ignition signal 431 is input to the transistor 33 by way of the resistor 35. It is designed so that a high voltage is developed at the ignition coil 1 just when the rotating rotor 153 comes to face the side electrodes 151 to which the spark plugs 10 are connected, respectively.

While there is a gap of about 0.5 mm between a fan-shaped end of the rotor 153 and the associated side electrode 152, the pulsed high voltage, not to mention the high voltage for ignition, can go over the gap with a quite small loss to reach the spark plugs 10.

In case of a four-cycle engine, the ignition cycle occurs every two revolutions of the crankshaft, so the rotor 153 of the distributor 15 is adapted to rotate once every two revolutions of the crankshaft.

Figure 3:
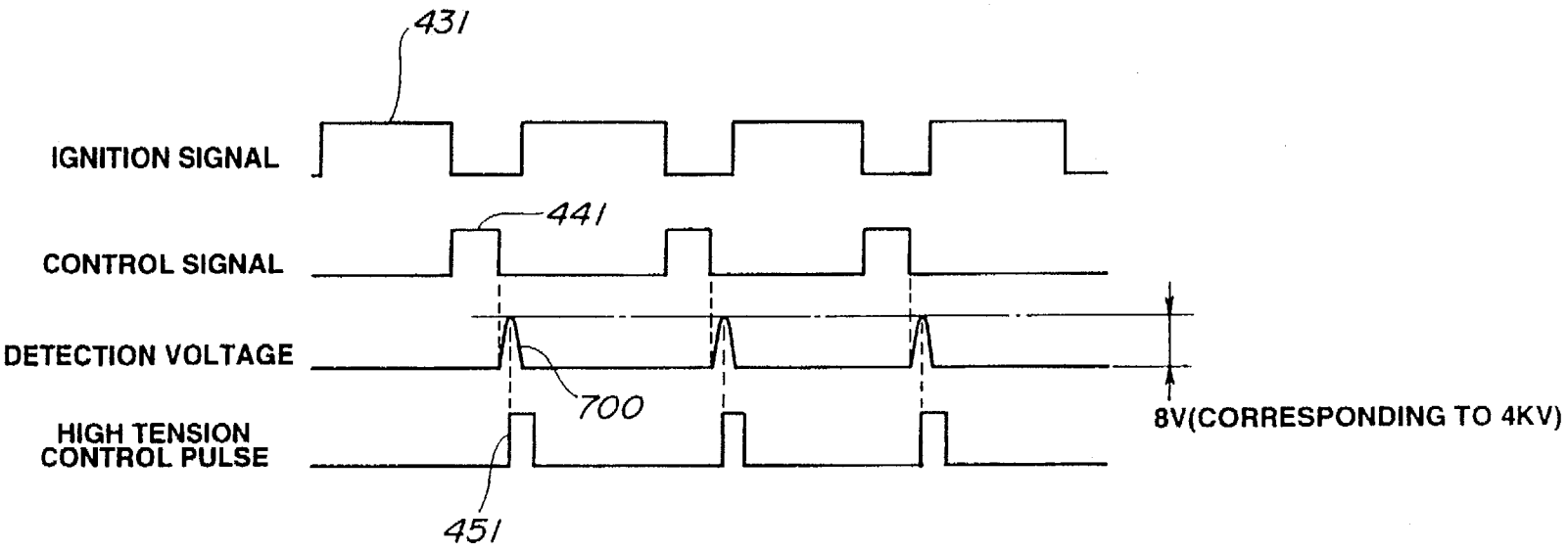
FIG. 3 is a diagram of various waveforms for signals, etc. for the ignition system of FIG. 2.
Figure 4:
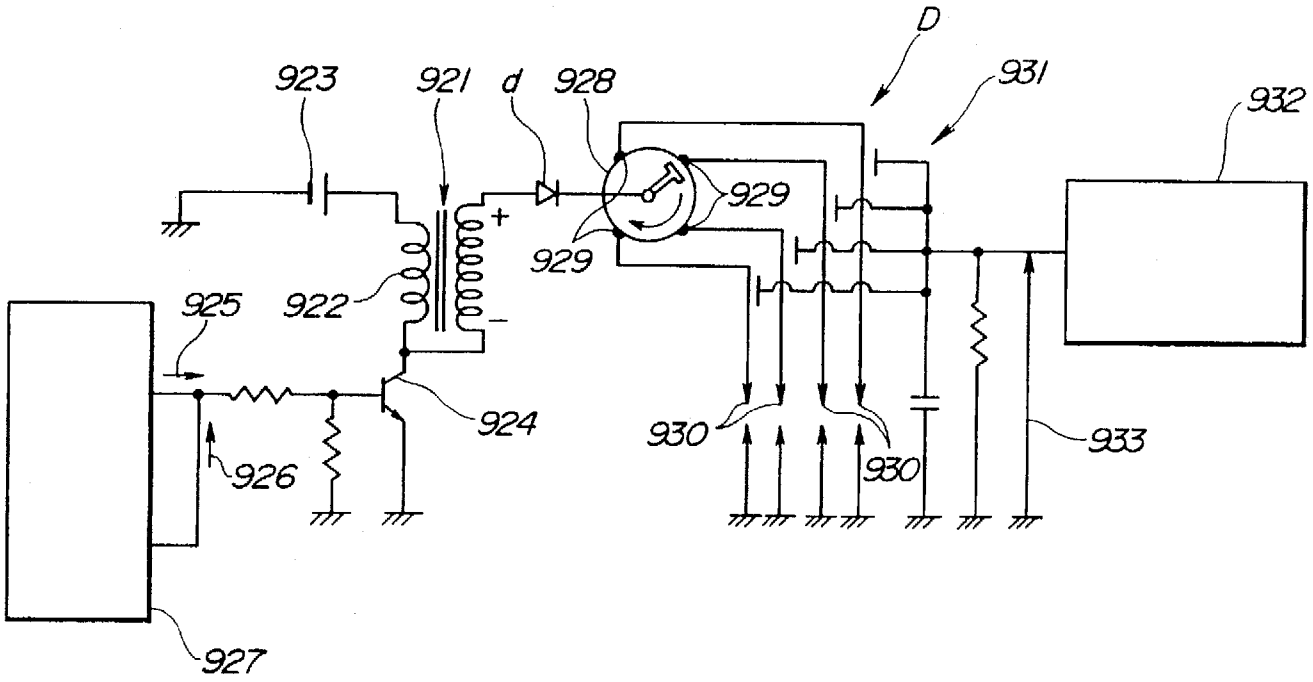
FIG. 4 (PRIOR ART)
FIG. 4 is a view similar to FIG. 2 but shows a prior art ignition system.

Further, the control signal generating section 44 of the ECU 4 delivers the control signal 441 which is maintained at a high state for a predetermined time in relation to the ignition signal 431, and the ignition signal 431 is input to the transistor 33 by way of he resistor 35 (refer to FIG. 3).

A voltage control circuit 45 is provided to monitor the detection voltage 700 and monitor the high tension control pulse 451 having a rise-up portion encroaching into the high level side (ignition signal 431). The high tension control pulse 451 is input to the transistor 33 by way of the resistor 36 (refer to FIG. 3).

In this embodiment, the decay time measuring section 81 of the combustion condition or misfire detecting circuit 8 measures the decay time of each detection voltage 700 that is developed each time of application of the pulsed high voltage. The determination section 82 determines a misfire at each cylinder on the basis of how the detection voltage 70 attenuates.

Then, an advantage of this embodiment will be described.

(b) The voltage control circuit 45 monitors the detection voltage 700 and delivers the high tension pulse 451 when the detection voltage 700 caused by the application of the pulsed high voltage 451 increases up to 8V for thereby restricting the peak value of the pulsed high voltage 451 to 4 kilovolts or less.

For this sake, firing or discharge of the spark plugs 10 is not caused by the application of the pulsed high voltage 451. Further, it becomes possible to apply a pulsed voltage of a highest possible value (4 kV) that does not cause firing or spark discharge, to the spark plugs 10, and therefore the accuracy in determination of a misfire at each cylinder can be high. Thus, the voltage detecting circuit 45 constitutes a control means for monitoring the detection voltage 700 between the center electrode and the outer electrode of each spark plug 10 that results from application of a pulsed high voltage, and for controlling the power transistor 33 that constitutes a high voltage applying means, such that the peak of the detection voltage is maintained at a highest possible value that does not cause firing of the spark plug 10.

While the present invention has been described and shown as above, the following modifications or variations can be made within the scope of the present invention.

(1) The predetermined peak value of the pulsed high voltage or the restriction value of the detection voltage are not limited to 2 kilovolts or 4 kilovolts (predetermined peak value) and 8 volts (restriction value) but can be of other voltages that do not cause spark discharge and can be otherwise set suitably.

(2) The number of the cylinders of the engine is not limited to four but can be six, eight, etc.

(3) The voltage detecting means can be of any other circuit structure so long as it can detect the plug voltage across the center electrode-to-outer electrode after reducing the plug voltage.

What is claimed is:

1. A misfire detecting device incorporated in an ignition system for supplying a primary current intermittently to a primary winding of an ignition coil for thereby developing an ignition high voltage at a secondary winding of the ignition coil, and applying the ignition high voltage to a plurality of spark plugs provided to respective cylinders of an internal combustion engine, the misfire detecting device comprising:

high voltage applying means for applying a pulsed high voltage to each spark plug after completion of firing of each spark plug;

voltage detecting means for detecting a plug voltage between a center electrode and an outer electrode of each spark plug;

control means for monitoring a detection voltage between the center electrode and the outer electrode of each spark plug caused by application of said pulsed high voltage, and for controlling said high voltage applying means so that a peak of said detection voltage is maintained at a highest possible value that does not cause firing of the spark plug; and misfire detecting means for detecting a misfire at each cylinder of the engine on the basis of a decay characteristic of the plug voltage caused by application of said pulsed high voltage.

2. The misfire detecting device according to claim 1, wherein said high voltage applying means comprises a power transistor and said control means comprises a voltage control circuit for outputting a control pulse to said power transistor when said detection voltage reaches a predetermined value.

3. The misfire detecting device according to claim 1, wherein said highest possible value is 2 kV.

* * * * *